US007377614B2

(12) United States Patent
Hatayama

(10) Patent No.: US 7,377,614 B2
(45) Date of Patent: May 27, 2008

(54) PRINT INSPECTION DEVICE, PRINTER PROVIDED WITH THE SAME AND PRINT INSPECTION METHOD

(75) Inventor: Fumihiro Hatayama, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 406 days.

(21) Appl. No.: 11/188,636

(22) Filed: Jul. 26, 2005

(65) Prior Publication Data

US 2006/0023018 A1 Feb. 2, 2006

(30) Foreign Application Priority Data

Jul. 29, 2004 (JP) ..... P2004-221360

(51) Int. Cl.
*B41J 29/393* (2006.01)
*B41J 2/165* (2006.01)

(52) U.S. Cl. ..... 347/19; 347/23

(58) Field of Classification Search ..... 347/19, 347/13, 42, 22, 23, 24, 29, 30, 32, 33
See application file for complete search history.

(56) References Cited

U.S. PATENT DOCUMENTS 6,435,644 B1 * 8/2002 Askeland et al. ..... 347/19
6,561,615 B2 * 5/2003 Okawa et al. ..... 347/19
7,275,801 B2 * 10/2007 Chiwata ..... 347/19

FOREIGN PATENT DOCUMENTS

JP 11-254796 A 9/1999
JP 2000-52542 A 2/2000
JP 2003-11336 A 1/2003

* cited by examiner

*Primary Examiner*—Shih-wen Hsieh
(74) *Attorney, Agent, or Firm*—McDermott Will & Emery LLP

(57) ABSTRACT

A carriage, which moves an inkjet head group composed of a plurality of inkjet head arrays laid approximately perpendicular to a printing paper transport direction, carries a line charge-coupled device (CCD). The line CCD has a reader element array composed of a plurality of reader elements laid in the same direction as the printing paper transport direction. The line CCD has a width along the printing paper transport direction, which is greater than a width of the inkjet head group. When the carriage moves, the line CCD scans the printing paper in the secondary scanning direction. Ink ejection inspection is made based on an image read by the line CCD.

17 Claims, 9 Drawing Sheets

PRINT INSPECTION DEVICE, PRINTER PROVIDED WITH THE SAME AND PRINT INSPECTION METHOD

BACKGROUND OF THE INVENTION

1. Field of the Invention

The present invention relates to a print inspection device and particularly to ink ejection inspection for a type of printers in which printing is made by ejecting ink.

2. Description of the Related Art

Inkjet printers, which have been used conventionally, make a print by ejecting ink onto paper by means of heat or pressure. Printers of this type include an inkjet head group composed of a plurality of inkjet heads each having an array of nozzles from which ink is ejected. FIG. 9 is a plane view showing a configuration of the inkjet head group 10 in a conventional printer. As shown in FIG. 9, an inkjet head array is formed by as many as "n" inkjet heads H1-Hn staggered in two lines. Four inkjet head arrays 2C, 2M, 2Y and 2K line up in a paper transport direction, for ejection of inks in color C (Cyan), color M (Magenta), color Y (Yellow) and color K (Black). Some printers are provided with a backup inkjet head array for each color.

A problem in such a printer is drying up of ink which occurs in the nozzles while the printer is not in use. The dried ink clogs the nozzles and can cause poor ejection of ink. When this happens, cleaning operations of the inkjet head (e.g. purge cleaning and wipe cleaning) is performed. Purge cleaning is an operation in which clogged nozzles are cleaned by sucking. Wipe cleaning is an operation in which inks delivering to the inkjet head are cleaned by scrubbing. The inkjet head is more susceptible to damage by wipe cleaning than by purge cleaning. So, generally, wipe cleaning is performed only when purge cleaning has not successfully solved the problem of poor ink ejection.

In order to deal with poor ink ejection as described, following proposals are made: JP-A 11-254796 discloses an inspection device which includes a printer unit provided with an ink jet nozzle head, and an inspection unit provided with an imaging camera for inspection. The inspection unit enables a continuous inspection of the state of the print in synchronization with printing operation. JP-A 2000-52542 discloses a device incorporating a photo sensor, in which a light emitting element and a light receiving element are disposed in such a way that the optical axis is set at a predetermined angle with respect to a recording head nozzle array. Ink ejected from the recording head crosses the optical axis and varies photo sensor output, and this variation is used for ink ejection inspection. JP-A 2003-11336 discloses a method of inspecting of printing quality, in which a line is printed on a paper margin in continuous printing operation and imaging means captures an image of the line and this image is checked against a pre-registered image.

However, devices disclosed in JP-A 11-254796 and JP-A 2000-52542 are for moving-type recording heads, and not applicable to non-moving type (hereinafter called "fixed type") in which a full-line recording head is fixed along the width of printing paper. The device according to JP-A 2003-11336 requires imaging means capable of capturing images as wide as the printing width, which requires increased cost when the printing width is large.

SUMMARY OF THE INVENTION

It is therefore an object of the present invention to provide an inexpensive device capable of detecting poor printing due to poor ink ejection for example, in order to prevent inappropriate printing in fixed-type ink printers incorporating a recording head such as an inkjet head.

An aspect of the present invention provides a print inspection device which inspects a state of a print for a printer. The printer includes a printhead group having a plurality of printheads, and the print is printed by causing each printhead to deliver ink to printing paper.

The print inspection device includes: an image reader which has a reader element array disposed in such a way that a scanning width of the reader element array is greater than a width of the printhead group in the group's primary scanning direction, and reads an image printed on the printing paper by scanning the printing paper in a secondary scanning direction of the printhead group; and an image processor which inspects the state of the print printed by the printer, based on image data which represent the image read by the image reader.

According to an arrangement such as the above, an image printed on the printing paper is read by scanning the printing paper with the image reader which has the reader element array disposed in such a way that the scanning width of the reader element array is grater than the primary scanning width of the printhead group. Therefore, the image, which is printed by the plurality of printheads included in the printhead group, is read in a single pass of scanning of the image reader. This reduces time necessary for reading an image for inspection of the state of printing, and improves overall efficiency in the printing process. Further, this enables to read an image printed on the printed paper, without providing an image reader which has a width as wide as the secondary scanning direction of the printhead group. As a result, it makes possible to inspect the state of printing at a low cost, and to reduce trashy prints.

In the print inspection device as described above;

the reader element array may be approximately perpendicular to the secondary scanning direction of the printhead group.

According to an arrangement such as the above, an image printed on the printing paper is read by scanning the printing paper with the image reader having the reader element array which is approximately perpendicular to the secondary scanning direction of the printhead group. Therefore images which are printed sequentially in the scanning direction of the image reader is read by the same reader elements. This increases accuracy of the inspection results, and increases accuracy of correction when the amount of ink ejection is corrected on the basis of the inspection results. Further, by reducing the scanning speed when the image reader scans the printing paper, it enables precise sampling of the image for increased resolution. This further increases the accuracy of correction.

In this configuration, it may be that the print inspection device further comprises:

a carriage mounted with the printhead group and the image reader; and a printhead group mover for moving the carriage between a printing position which is a position of the printhead group when the plurality of printheads perform printing and a cleaning position which is a position of the printhead group when the plurality of printheads are cleaned.

According to an arrangement such as the above, the image reader is mounted on a carriage which is for moving the printhead group. This enables to move the image reader, without employing an additional component for moving the image reader, and to inspect the state of printing at a low cost. Further, since the printhead group and the image reader are moved by a single carriage, overall efficiency in the printing process is improved.

Another aspect of the present invention provides a printer which makes a print by delivering ink to printing paper.

The printer includes: a printhead group having a plurality of printheads which deliver the ink to the printing paper;

an image reader which has a reader element array disposed in such a way that a scanning width of the reader element array is greater than a width of the printhead group in the group's primary scanning direction, and reads an image printed on the printing paper by scanning the printing paper in a secondary scanning direction of the printhead group; and an image processor which inspects a state of the print based on image data which represent the image read by the image reader.

Still another aspect of the present invention provides a print inspection method of inspecting a state of a print for a printer. The printer includes a printhead group having a plurality of printheads, and the print is printed by causing each printhead to deliver ink to printing paper.

The method includes: a step of reading an image printed on the printing paper by an image reader which includes a reader element array disposed in such a way that a scanning width of the reader element array is greater than a width of the printhead group in the group's primary scanning direction, by scanning the printing paper in a secondary scanning direction of the printhead group; and a step of inspecting a state of the print printed by the printer, based on image data which represent the image read by the image reader.

These and other objects, features, aspects and advantages of the present invention will become more apparent from the following detailed description of the present invention when taken in conjunction with the accompanying drawings.

DESCRIPTION OF THE PREFERRED EMBODIMENT

Hereinafter, an embodiment of the present invention will be described with reference to the attached drawings.

<1. Overall Configuration and Operation>

Figure 1:
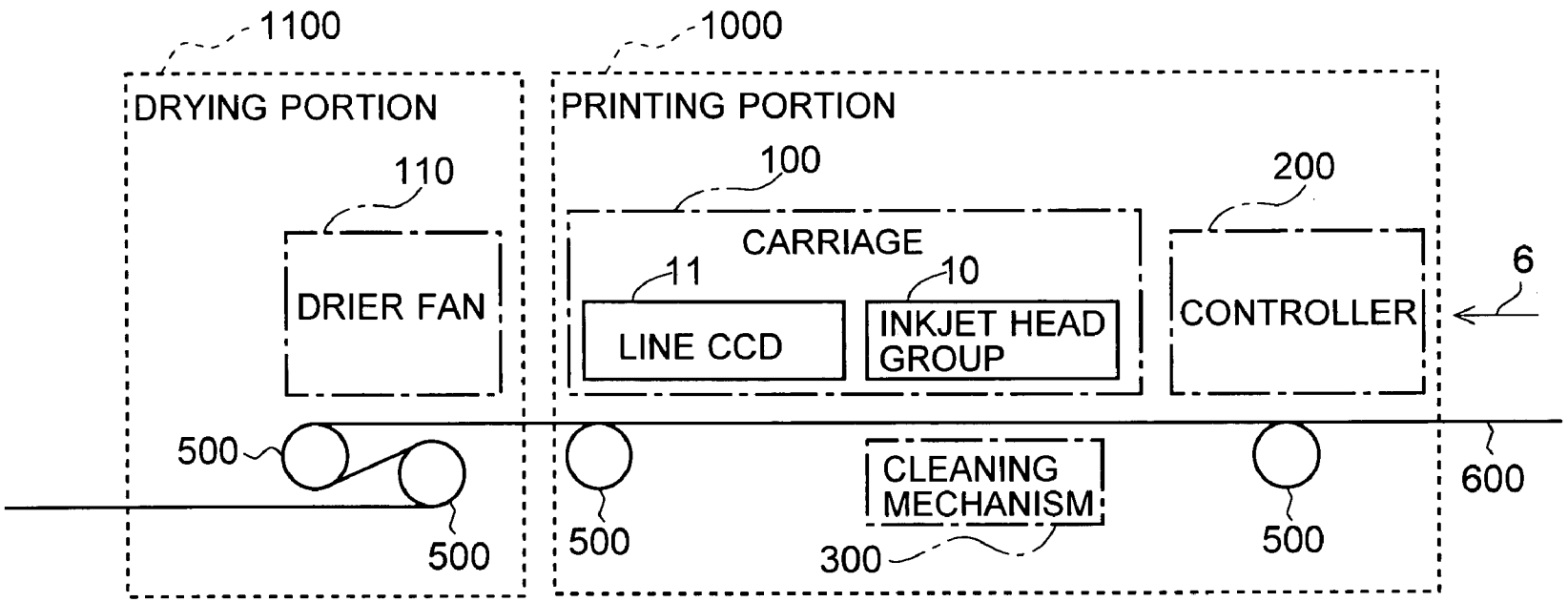
FIG. 1 is a schematic diagram of a primary portion of an inkjet printer according to an embodiment of the present invention.

FIG. 1 is a schematic diagram of a primary portion of an inkjet printer as an embodiment of the present invention. The printer primarily includes a printing portion 1000 and a drying portion 1100. The printing portion 1000 includes: a carriage 100 mounted with an inkjet head group 10 serving as a printhead group and a line CCD 11 serving as an image reader; a controller 200; and a cleaning mechanism 300. The drying portion 1100 includes a drier fan 110. In addition, the printing portion 1000 and the drying portion 1100 are provided with a belt 600 for carrying printing paper and rollers 500 for driving the belt 600.

As explained below, the inkjet head group 10 is composed of a plurality of inkjet head arrays. Each inkjet head array has a plurality of inkjet heads. By ejecting ink from nozzles of the inkjet heads, printing paper on the belt 600 is performed. The line CCD 11 reads an image printed on the paper, and sends the image to the controller 200. The carriage 100 carries the inkjet head group 10 and the line CCD 11. As the carriage 100 moves, inkjet head group 10 moves between a printing area (printing position) and a cleaning area (cleaning position) to be described later. The controller 200 controls the printer, based on the image read by the line CCD 11. The cleaning mechanism 300 performs cleaning operations such as purge cleaning and wipe cleaning to the inkjet head. The drier fan 110 dries the printed paper sent from the printing portion 1000 to the drying portion 1100.

Figure 2:
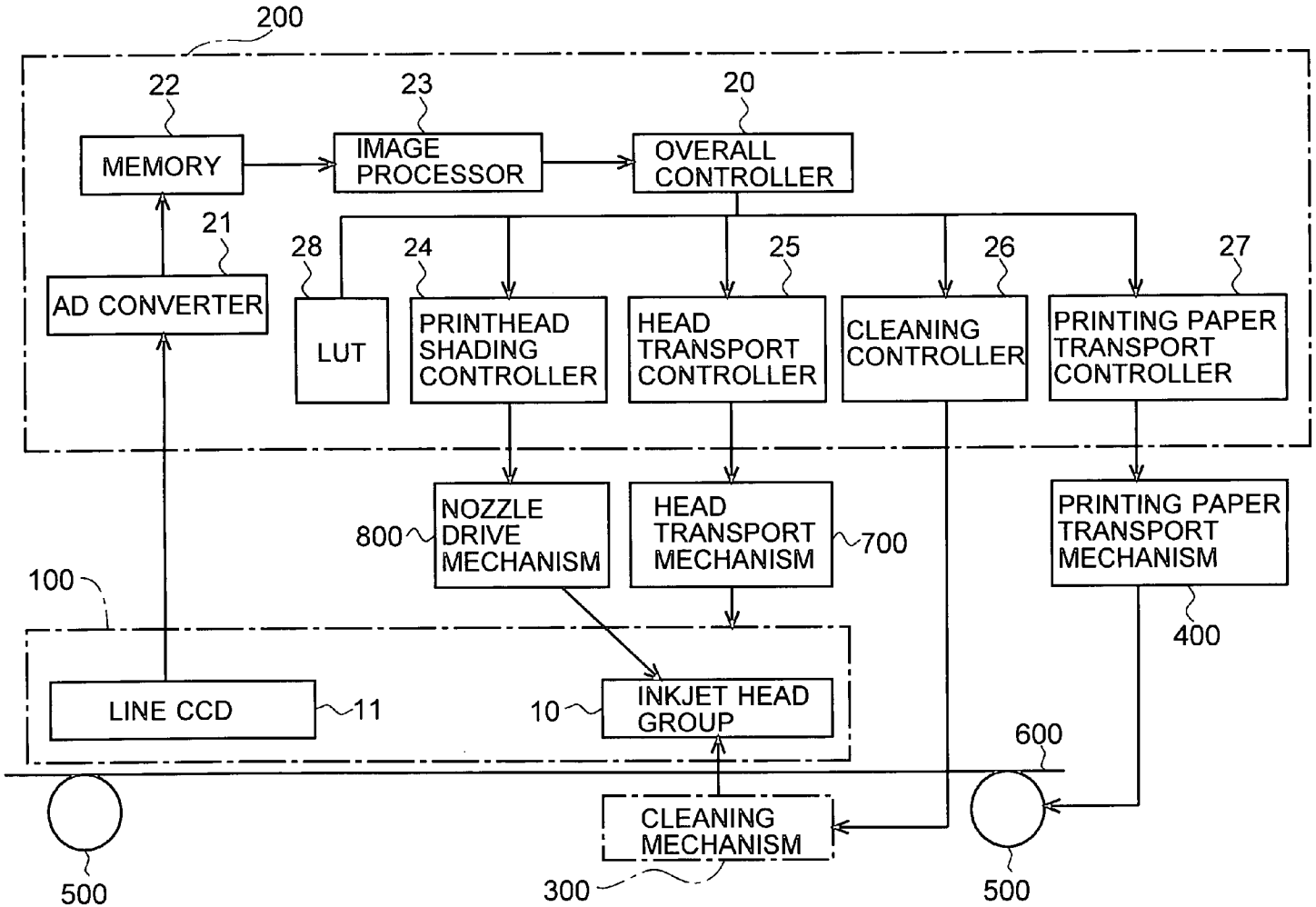
FIG. 2 is an overall configuration diagram of a printing portion of the inkjet printer according to the embodiment.

FIG. 2 is an overall configuration diagram of the printing portion 1000 of the inkjet printer according to the present embodiment. The printing portion 1000 of this printer includes the carriage 100, the controller 200, the cleaning mechanism 300, the rollers 500 and the belt 600 as mentioned above, and in addition, includes a printing paper transport mechanism 400, a head transport mechanism 700 serving as a printhead group mover, and a nozzle drive mechanism 800.

The controller 200 includes an overall controller 20, an AD (Analog to Digital) converter 21, a memory 22, an image processor 23, a printhead shading controller 24, a head transport controller 25, a cleaning controller 26, a printing paper transport controller 27, and an LUT (Look Up Table) 28. The overall controller 20 controls operation of the entire printer. The AD converter 21 converts an analog image taken by the line CCD 11 into a digital image. The memory 22 stores image data after the AD conversion. The image processor 23 reads the image data out of the memory 22 and performs an ink ejection inspection. The ink ejection inspection is to checks if ink is properly ejected from each nozzle in each inkjet head by matching process in which the image data read by the line CCD 11 is checked against predetermined inspection data that represents a test pattern. The printhead shading controller 24 sends instruction signals to the nozzle drive mechanism 800 so that the amount of ink ejected by each nozzle of each inkjet head is adjusted based on results of the ink ejection inspection made by the image processor 23. The head transport controller 25 sends instruction signals to the head transport mechanism 700 in order to move the carriage 100 to a selected position. The cleaning controller 26 sends instruction signals to the cleaning mechanism 300 so that cleaning is performed for each inkjet head array based on results of the ink ejection inspection made by the image processor 23. The cleaning controller 26 and the cleaning mechanism 300 embody the cleaning portion. The printing paper transport controller 27 sends instruction signals to the printing paper transport mechanism 400 in order to move the printing paper to a situated position. The LUT 28 is a reference table used for shading correction in the printing process. The shading correction is to adjust the amount of ink ejected from each nozzle when printing is made on paper, in order to correct performance inconsistency among the nozzles in the inkjet head. The LUT 28 stores values for adjusting the amount of ink ejected per nozzle.

The nozzle drive mechanism 800 drives the nozzles based on the instruction signals sent from the printhead shading controller 24. The nozzle drive mechanism 800 has a plurality of drive units so each single nozzle is driven individually. The printhead shading controller 24 and the nozzle drive mechanism 800 embody an ink ejection amount adjustment portion. The head transport mechanism 700 moves the carriage 100 based on the instruction signals sent from the head transport controller 25. The cleaning mechanism 300 cleans the inkjet heads based on the instruction signals sent from the cleaning controller 26. The cleaning mechanism 300 has a plurality of cleaning units so each single inkjet head array is cleaned individually. The printing paper transport mechanism 400 rotates the rollers 500 based on the instruction signals sent from the printing paper transport controller 27. Rotation of the rollers 500 drives the belt 600, moving the paper on the belt 600 from the printing portion 1000 to the drying portion 1100.

As mentioned above, the head transport mechanism 700 moves the carriage 100, and the carriage 100 is mounted with the inkjet head group 10 and the line CCD 11. Therefore, as the head transport mechanism 700 moves the carriage 100, so moved are the inkjet head group 10 and the line CCD 11.

Figure 3A:
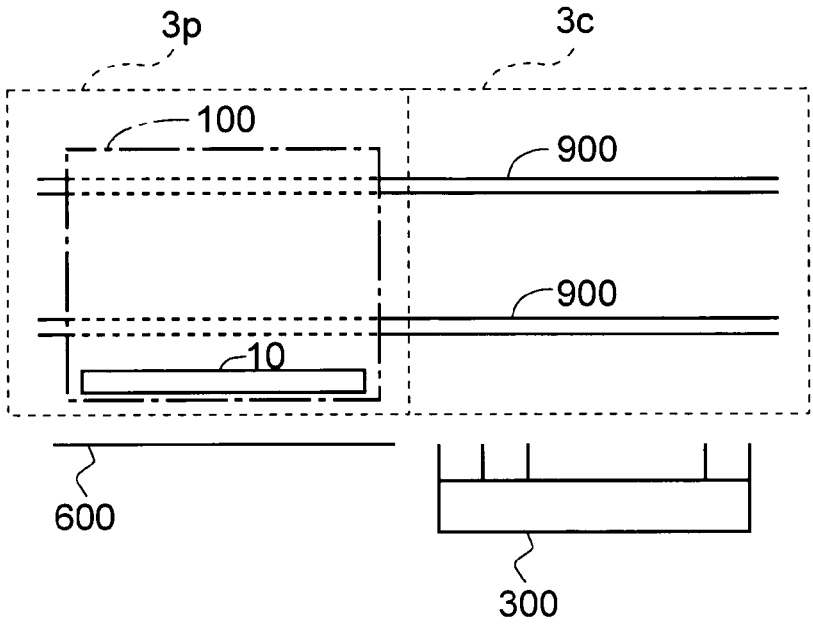
FIG. 3A and FIG. 3B are front views of the inkjet printer according to the embodiment.
Figure 3B:
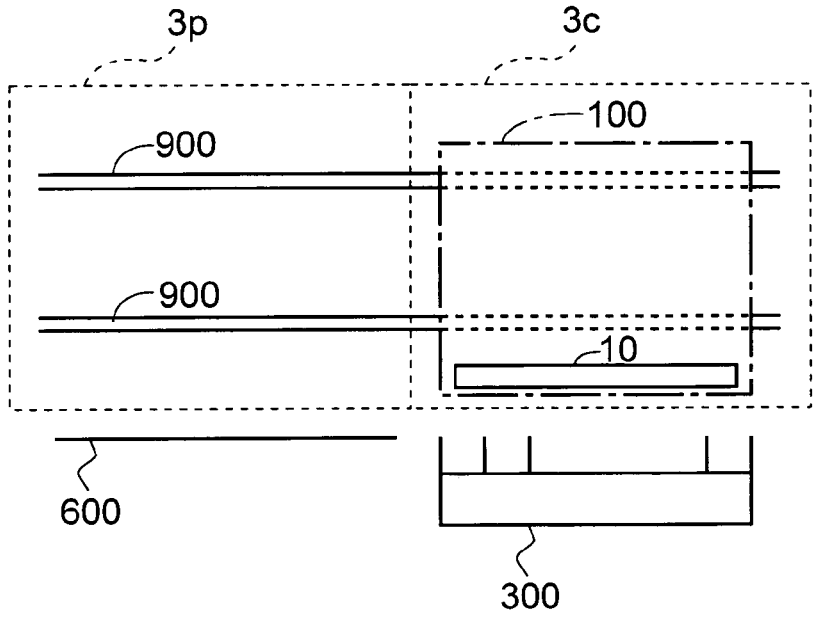

FIG. 3A and FIG. 3B are front views of the inkjet printer as viewed from the direction indicated by an arrow 6 in FIG. 1. FIG. 3A shows the position of carriage 100 when printing is made on paper. FIG. 3B shows the position of carriage 100 when cleaning of the inkjet head is performed. In the following description, an area indicated by reference symbol 3*p* will be called printing area whereas an area indicated by reference symbol 3*c* will be called cleaning area.

As shown in FIG. 3A and FIG. 3B, the printer is provided with a guide member 900 for the carriage 100 to be able to move between the printing area 3*p* and the cleaning area 3*c*. Since the carriage 100 is mounted with the inkjet head group 10 as mentioned above, when the carriage 100 moves to the printing area 3*p* as shown in FIG. 3A, the inkjet head group 10 is brought to a position where printing onto paper is possible. On the other hand, when the carriage 100 moves to the cleaning area 3*c* as shown in FIG. 3B, the inkjet head group 10 is brought to a position where cleaning of the inkjet head is possible.

<2. Inkjet Head and Line CCD Configuration>

Figure 4:
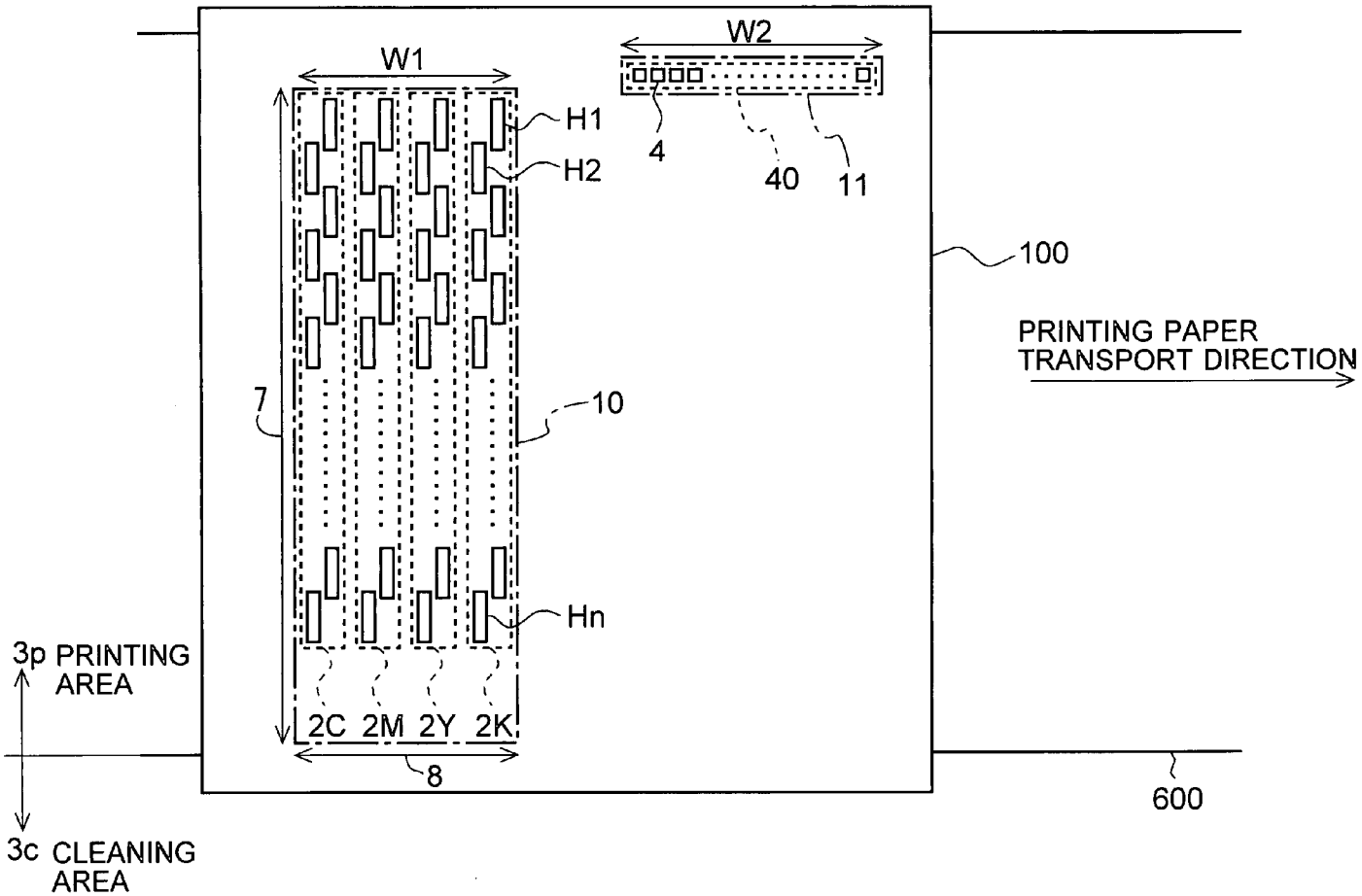
FIG. 4 is a plane view showing a configuration of an inkjet head group and a line charge-coupled device (CCD) according to the embodiment.

FIG. 4 is a plane view showing the configuration of the inkjet head group 10 and the line CCD 11 according to the present embodiment. As shown in FIG. 4, in the present embodiment, the line CCD 11 is mounted on the carriage 100 which moves the inkjet head group 10. The inkjet head group 10 is composed of inkjet head arrays (printhead arrays) 2C, 2M, 2Y, and 2K for color C (Cyan), color M (Magenta), color Y (Yellow), and color K (Black), laid respectively in the printing paper transport direction. Each inkjet head array has two rows, in which a total of "n" inkjet heads H1-Hn are disposed in a staggered pattern. The line CCD 11 has a reader element array 40 which includes a plurality of reader elements 4.

As shown in FIG. 4, each inkjet head array is perpendicular to the paper transport direction. Further, each inkjet head array has a printing width which is wider than the width of inkjet head group along the paper transport direction. Specifically, for the inkjet head group 10, the longitudinal direction is a direction indicated by reference symbol 7 in FIG. 4 whereas the widthwise direction is a direction indicated by reference symbol 8. Therefore, the longitudinal direction of the inkjet head group 10 is perpendicular to the paper transport direction. On the other hand, the reader element array 40 of the line CCD 11 is laid along the paper transport direction. Thus, the longitudinal direction of the inkjet head group 10 is perpendicular to the reader element array 40 of the line CCD 11. The inkjet head group 10 has a widthwise dimension or a width W1, and the line CCD 11 has a scanning width (a width along the paper transport direction) W2. The width W2 is greater than the width W1.

With above-mentioned configuration, when a test pattern is printed, the printing paper transport controller 27 sends instruction signals to the printing paper transport mechanism 400 so that line CCD 11 can read the printed test pattern. Based on the instruction signals, the printing paper transport mechanism 400 moves the printing paper to a predetermined position. Further, in order to move the carriage 100, the head transport controller 25 sends instruction signals to the head transport mechanism 700. Based on the instruction signals, the head transport mechanism 700 moves the carriage 100 from the printing area 3*p* to the cleaning area 3*c*. As a result, the line CCD 11 also moves from the printing area 3*p* to the cleaning area 3*c*. Thus, the line CCD 11 scans the paper in a secondary scanning direction, i.e. in the longitudinal direction of the inkjet head group 10, and reads an image on the paper (test pattern). As has been mentioned, since the scanning width W2 of the line CCD 11 is greater than the width W1 of the inkjet head group 10, if the head transport mechanism 700 move the carriage 100 only once from the printing area 3*p* to the cleaning area 3*c*, then the image of the entire test pattern is read by the line CCD 11.

<3. Printing Process>

Figure 5:
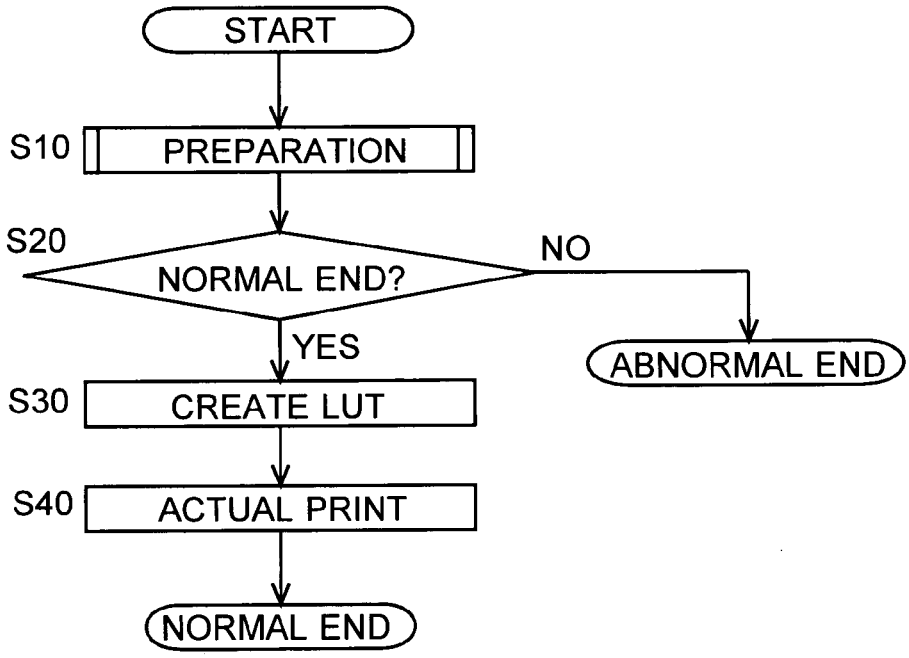
FIG. 5 is a flowchart showing a sequence of steps in the printing process according to the embodiment.

Next, steps of printing process in the present embodiment will be described. FIG. 5 is a flowchart which shows a sequence of steps in the printing process according to the present embodiment. When the printing process starts, first, a preparation is performed (Step S10). The preparation means ink ejection inspections of the nozzles in the inkjet heads H1-Hn and cleaning operations performed to the inkjet heads H1-Hn based on results of the ink ejection inspections. Details of the preparation will be described later. After Step S10, the process goes to Step S20, where the overall controller 20 checks whether or not the preparation has been finished properly. If the preparation has been made properly, the process goes to Step S30, whereas the process ends without performing the printing operation if the preparation was not finished normally (if finished abnormally).

In Step S30, an LUT 28 for shading correction is created, as follows: First, the image processor 23 reads image data which was scanned by the line CCD 11 and stored in the memory 22. Further, the image processor 23 determines adjustment values for each nozzle based on the image data, so that the amount of ink ejected by each nozzle is consistent, and writes the adjustment values into the LUT 28. The LUT 28 is thus completed. After Step S30, the process goes to Step S40, where the autual printing operation is performed. In this step, in order to make sure that the amount of ink ejected by each nozzle is consistent, the printhead shading controller 24 makes reference to the LUT 28 and sends instruction signals to the nozzle drive mechanism 800. Based on the instruction signals sent from the printhead shading controller 24, the nozzle drive mechanism 800 makes each nozzle to eject the ink. After Step S40, the printing process ends.

<4. Ink ejection inspection and Cleaning Operation>

Figure 6:
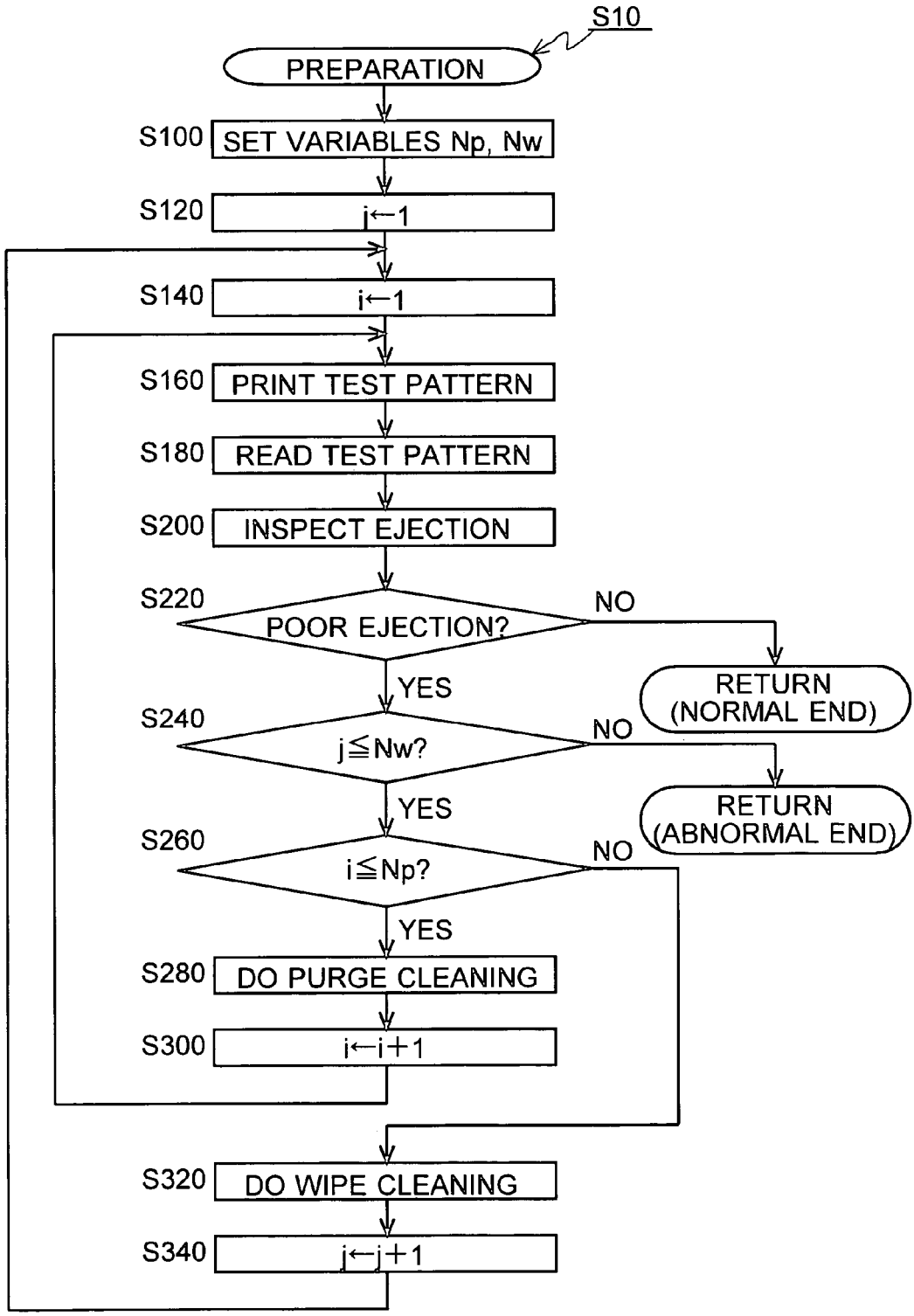
FIG. 6 is a flowchart showing a sequence of steps in the printing preparation process according to the embodiment.

Next, description will be made for the preparation according to the present embodiment. As mentioned above, the preparation means ink ejection inspection and cleaning operation for the nozzles of the inkjet heads H1-Hn. FIG. 6 is a flowchart showing a sequence of steps in the preperation of printing process. When the preparation starts, the overall controller 20 sets a variable Np which represents a maximum number of purge cleaning cycles (predetermined purge times) to be repeated before a cycle of wipe cleaning is performed, and a variable Nw which represents a maximum number of wipe cleaning cycles (predetermined wipe times) to be performed within a printing process (Step S100). Thereafter, the overall controller 20 sets a value "1" to a variable j (Step S120). This variable indicates how many times the wipe cleaning will have been made since the start of preparation if the cleaning is made next time. Further, the overall controller 20 sets a value "1" to a variable i (Step S140). This variable indicates how many times the purge cleaning will have been made before the first wipe cleaning since the start of preparation or between two wipe cleaning cycles if the purge cleaning is made next time.

Figure 7:
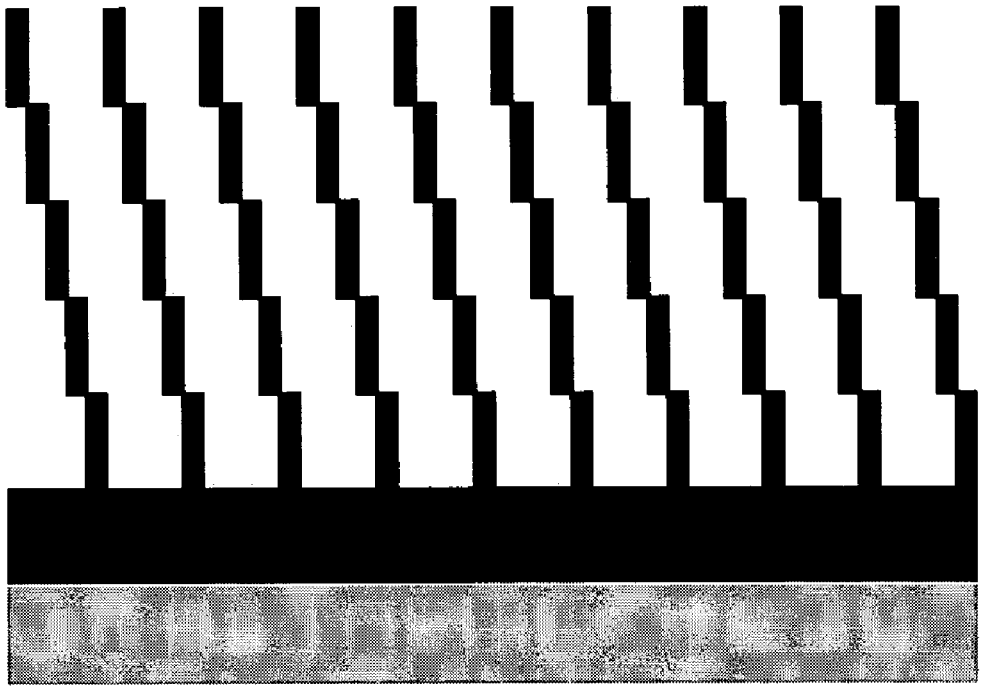
FIG. 7 shows an example of a test pattern for ink ejection inspection according to the embodiment.

In step S160, the inkjet head group 10 prints a test pattern on printing paper for ink ejection inspection. FIG. 7 shows an example of the test pattern. Such a test pattern is printed on a piece of printing paper, and in the ink ejection inspection to be described later, the test pattern is read by the line CCD 11. In Step S180, the test pattern printed in Step S160 is read by the line CCD 11. For this step, the head transport controller 25 sends instruction signals to the head transport mechanism 700 in order to move the carriage 100 from the printing area 3*p* to the cleaning area 3*c* or from the cleaning area 3*c* to the printing area 3*p*. The head transport mechanism 700 moves the carriage 100 based on the instruction signals. As a result, line CCD 11 also moves from the printing area 3*p* to the cleaning area 3*c*, or from the cleaning area 3*c* to the printing area 3*p*. During this movement, the test pattern is read by the line CCD 11.

In step S200, ink ejection inspection is performed. In the ink ejection inspection, the image processor 23 caries out a matching process between the image data read by the line CCD 11 and the prestored inspection data as a proper representation of the test pattern. The matching process can be made using conventional method. In Step S220, the overall controller 20 checks if there is nonconformity or poor ink ejection as a results of matching process. If poor ink ejection is found as a result, then the process goes to Step S240 whereas the process brings the preparation to a "Normal End" and goes to Step 20 shown in FIG. 5 if no poor ink ejection is found.

In step S240, the overall controller 20 checks to see if the value of the variable j is not greater than the value of the variable Nw. If the result show that the value of the variable j is not greater than the value of the variable Nw, the process goes to Step S260. On the other hand, if the value of the variable j is greater than the value of the variable Nw, the preparation is brought to an "Abnormal End", and the process goes to Step S20 in the previous FIG. 5. Specifically, the cleaning operation is continued if the wipe cleaning cycle has not been performed as many times as specified by the predetermined wipe times since the start of preparation. If the wipe cleaning cycle has already been made as many times as the predetermined wipe times, then the process is brought to an abnormal end.

In step S260, the overall controller 20 checks if the value of the variable i is not greater than the value of the variable Np. If the result shows that the value of the variable i is not greater than the value of the variable Np, the process goes to Step S280, whereas it goes to Step S320 if the value of the variable i is greater than the value of the variable Np. Specifically, purge cleaning is performed if it has not been performed as many times as the predetermined purge times since the start of the preparation till the first wipe cleaning is performed, or between two consecutive cycles of wipe cleaning. On the other hand, wipe cleaning is performed if purge cleaning has been performed as many times as specified by the predetermined purge times.

In step S280, the purge cleaning is performed. In this operation, the cleaning controller 26 sends instruction signals to each cleaning mechanism 300 so that the purge cleaning will be performed only to the inkjet heads in those inkjet head arrays where poor ink ejection was found. Based on the instruction signals, the cleaning mechanism 300 performs purge cleaning to the inkjet heads. For example, there are a total of four inkjet head arrays 2C, 2M, 2Y, and 2K serving for colors C, M, Y and K respectively. If the poor ink ejection is found only in nozzles in inkjet heads of two inkjet head arrays 2C, 2Y which work for the color C and the color Y, then purge cleaning is performed only to the inkjet heads included in the inkjet head arrays 2C and 2Y. After Step S280, the process goes to Step S300, where the overall controller 20 adds a value "1" to the value of the variable i. After Step S300, the process goes back to Step S160. In this manner, purge cleaning is repeated for up to the predetermined purge times as far as any of the nozzles show signs of poor ink ejection, before wipe cleaning is performed.

In step S320, wipe cleaning is performed. In this operation, the cleaning controller 26 sends instruction signals to each cleaning mechanism 300 so that the wipe cleaning will be performed only to the inkjet heads included in those inkjet head arrays where poor ink ejection was found. Based on the instruction signals, the cleaning mechanism 300 performs wipe cleaning. For example, there are a total of four inkjet head arrays 2C, 2M, 2Y, and 2K serving for colors C, M, Y and K respectively, and if the poor ink ejection is found only in nozzles in inkjet heads of one inkjet head array 2M which works for the color M, then wipe cleaning is performed only to the inkjet heads included in the inkjet head array 2M. After Step S320, the process goes to Step S340, where the overall controller 20 adds a value "1" to the value of the variable j. After Step S340, the process goes back to Step S140. In this manner, wipe cleaning is performed for up to the predetermined wipe times within a single printing process.

<5. Functions and Advantageous Effects>

As mentioned above, according to the embodiment, the carriage 100 which is mounted with an inkjet head group 10 is also mounted with a line CCD 11 which is capable of scanning the printing paper in the longitudinal direction of the inkjet head group 10, i.e. in the secondary scanning direction, as well as scanning at least a width in the widthwise direction of the inkjet head group 10. This enables the line CCD 11, which has a much narrower width than the width of the printing paper, to read images over the full width of printing paper, without employing an image reader which is capable of reading images over the full width of printing paper at one time. Thus, it becomes possible to perform ink ejection inspection at a low cost. Conventionally, the image reader in accordance with the printing width was required, so the cost reduction advantage will be drastic particularly in those printers whose printing width is large.

Further, according to the embodiment, cleaning operation is performed based on results of the ink ejection inspection, individually for each inkjet head array. Thus, the cleaning operation is performed only to the inkjet heads included in those inkjet head arrays which has a poor ink ejection. This reduces wear and tear of the inkjet heads due to the cleaning operation. Further, depending on results of the ink ejection inspection, shading correction is performed. Since the amount of ink ejection is adjusted for each nozzle, it is easy to reduce inconsistent ink ejection. As a result, it becomes possible to improve printing quality, to prevent trashy prints, and to reduce wasteful use of ink.

Further, since the line CCD 11 scans the printing paper in the longitudinal direction of the inkjet head group 10, the inkjet head nozzles which are laid in the scanning direction are inspected on the basis of an image read by the same reader element. This increases accuracy of the shading correction for the inkjet heads, solving effectively the problem of ink ejection inconsistency among the nozzles. Thus, non-uniform printing is prevented, and printing quality is improved. Also, by reducing the scanning speed when the line CCD 11 scans the printing paper, it enables precise sampling of the image for increased resolution. This further increases the accuracy of shading correction, leading to further improvement in printing quality.

<6. Others>

In the embodiment described above, a single carriage 100 carries an inkjet head group 10 and a line CCD 11; however, the present invention is not limited to this. For example, an inkjet head group 10 and a line CCD 11 may be mounted on different carriages 100 so the inkjet head group 10 may moved separately from the line CCD 11. Image reading by the line CCD 11 may be made when the carriage 100 moves from the printing area 3*p* to the cleaning area 3*c*, or when the carriage 100 moves from the cleaning area 3*c* to the printing area 3*p*. Alternatively, image reading may be made both ways, when the carriage 100 moves from the printing area 3*p* to the cleaning area 3*c* and when the carriage 100 moves from the cleaning area 3*c* to the printing area 3*p*. In the embodiment described above, description is made for an inkjet printer, but the present invention is not limited to this, and is applicable also to thermal transfer printers.

Figure 8A:
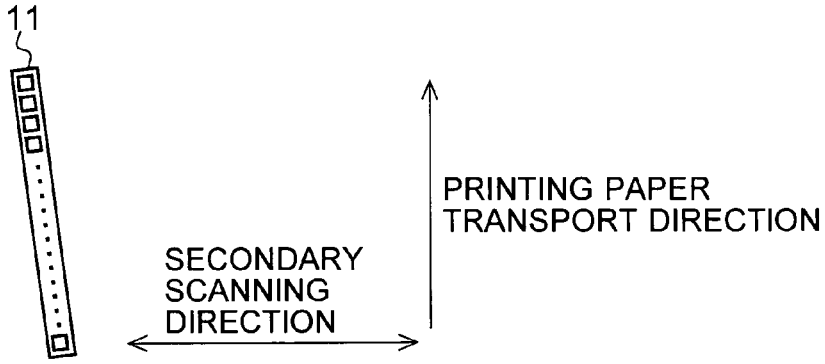
FIG. 8A and FIG. 8B are a configuration diagram of a line CCD in a variation of the embodiment.
Figure 8B:
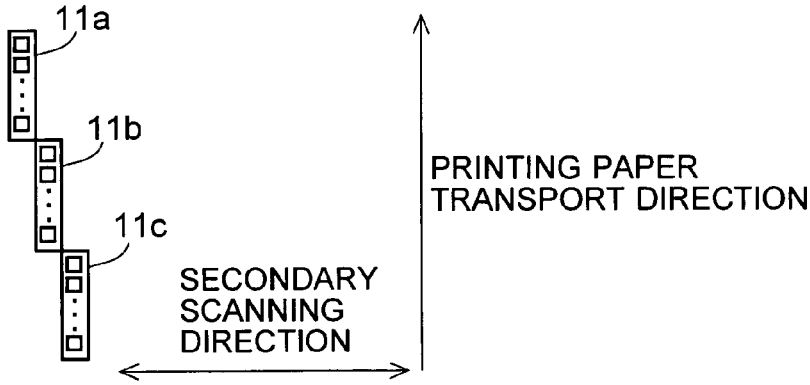
Figure 9:
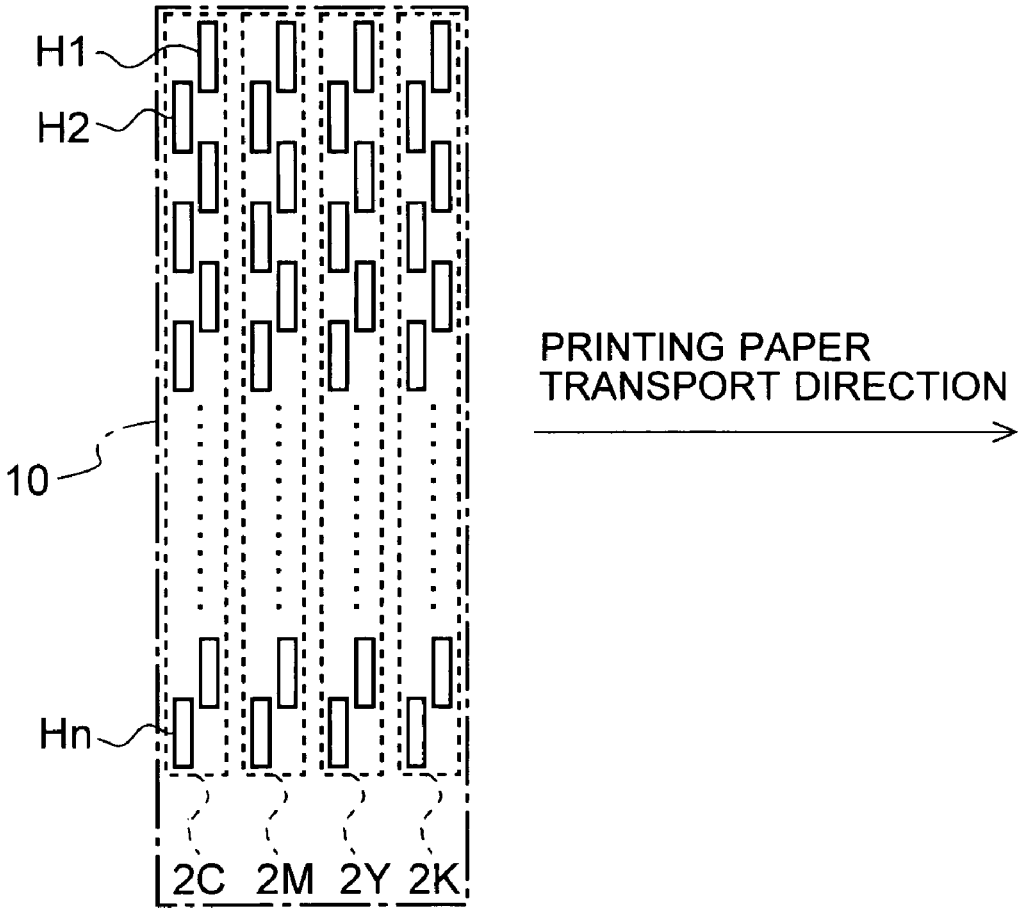
Fig.9 PRIOR ART
FIG. 9 is a plane view showing a configuration of an inkjet head group in a conventional printer.

Further, in the embodiment described above, the line CCD 11 is perpendicular to the longitudinal direction of the inkjet head group, i.e. the line CCD 11 is perpendicular to the secondary scanning direction of the printing paper; however, the present invention is not limited to this. For example, even if the line CCD 11 is not perpendicular to the secondary scanning direction of the printing paper as shown in FIG. 8A, the present invention can be applied by making the line CCD 11 read the printed image at varied timings for each pixel (by varying the amount of delay). Still further, as shown in FIG. 8B, the image reader may be composed of a plurality of line CCDs 11*a*, 11*b*, 11*c* which are perpendicular to the secondary scanning direction of the printing paper but staggered in the secondary scanning direction of the printing paper. In this case, the present invention can be applied by making each line CCD 11 read the printed image at a different timing (by varying the amount of delay).

While the invention has been described in detail, the foregoing description is in all aspects illustrative and not restrictive. It is understood that numerous other modifications and variations can be devised without departing from the scope of the invention.

The present application claims priority based on the Japanese Patent Application No. 2004-221360 filed on Jul. 29, 2004 under the title "PRINT INSPECTION DEVICE, PRINTER PROVIDED WITH THE SAME AND PRINT INSPECTION METHOD", the contents of which are hereby incorporated by reference.

What is claimed is:

1. A print inspection device which inspects a state of a print for a printer including a printhead group having a plurality of printheads, the print being printed by causing each printhead to deliver ink to printing paper, the print inspection device comprising:

an image reader including a reader element array disposed in such a way that a scanning width of the reader element array is greater than a width of the printhead group in a printing paper transport direction, the image reader reading an image printed on the printing paper by scanning the printing paper in a secondary scanning direction of the printhead group; and an image processor for inspection of the state of the print printed by the printer, based on image data which represent the image read by the image reader.

2. The print inspection device according to claim 1, wherein the reader element array is approximately perpendicular to the secondary scanning direction of the printhead group.

3. The print inspection device according to claim 1, further comprising:

a carriage mounted with the printhead group and the image reader; and a printhead group mover for moving the carriage between a printing position which is a position of the printhead group when the plurality of printheads perform printing and a cleaning position which is a position of the printhead group when the plurality of printheads are cleaned.

4. The print inspection device according to claim 3, wherein the image reader reads an image printed on the printing paper at least in one occasion of a time when the printhead group mover moves the carriage from the printing position to the cleaning position and a time when the printhead group mover moves the carriage from the cleaning position to the printing position.

5. The print inspection device according to claim 1, further comprising a cleaning portion for cleaning the plurality of printheads;

wherein the printhead group includes a plurality of printhead arrays each performing printing in a predetermined color; and wherein the cleaning portion cleans the plurality of printheads per printhead array depending on a result of inspection made by the image processor.

6. The print inspection device according to claim 1, wherein the plurality of printheads print by ink jet printing method in which ink is ejected from a plurality of nozzles.

7. The print inspection device according to claim 6, further comprising an ink ejection amount adjustment portion which adjusts an amount of ink ejected from each nozzle of the plurality of printheads depending on a result of inspection made by the image processor.

8. A printer which makes a print by delivering ink to printing paper, comprising:

a printhead group including a plurality of printheads which deliver the ink to the printing paper;

an image reader including a reader element array disposed in such a way that a scanning width of the reader element array is greater than a width of the printhead group in a printing paper transport direction, the image reader reading an image printed on the printing paper by scanning the printing paper in a secondary scanning direction of the printhead group; and an image processor which inspects a state of the print based on image data which represent the image read by the image reader.

9. The printer according to claim 8, wherein the reader element array is approximately perpendicular to the secondary scanning direction of the printhead group.

10. The printer according to claim 8, further comprising:

a carriage mounted with the printhead group and the image reader; and a printhead group mover for moving the carriage between a printing position which is a position of the printhead group when the plurality of printheads perform printing and a cleaning position which is a position of the printhead group when the plurality of printheads are cleaned.

11. The printer according to claim 10, wherein the image reader reads an image printed on the printing paper at least in one occasion of a time when the printhead group mover moves the carriage from the printing position to the cleaning position and a time when the printhead group mover moves the carriage from the cleaning position to the printing position.

12. The printer according to claim 8, further comprising a cleaning portion for cleaning the plurality of printheads;

wherein the printhead group includes a plurality of printhead arrays each performing printing in a predetermined color; and wherein the cleaning portion cleans the plurality of printheads per printhead array depending on a result of inspection made by the image processor.

13. The printer according to claim 8, wherein the plurality of printheads print by ink jet printing method in which ink is ejected from a plurality of nozzles.

14. The printer according to claim 13, further comprising an ink ejection amount adjustment portion which adjusts an amount of ink ejected from each nozzle of the plurality of printheads depending on a result of inspection made by the image processor.

15. A print inspection method of inspecting a state of a print for a printer including a printhead group having a plurality of printheads, the print being printed by causing each printhead to deliver ink to printing paper, the method comprising:

a step of reading an image printed on the printing paper by an image reader which includes a reader element array disposed in such a way that a scanning width of the reader element array is greater than a width of the printhead group in a printing paper transport direction, by scanning the printing paper in a secondary scanning direction of the printhead group; and a step of inspecting a state of the print printed by the printer, based on image data which represent the image read by the image reader.

16. The print inspection method according to claim 15, further comprising:

a step of moving the printhead group and the image reader between a printing position which is a position of the printhead group when the plurality of printheads perform printing and a cleaning position which is a position of the printhead group when the plurality of printheads are cleaned.

17. The print inspection method according to claim 15, wherein the printhead group includes a plurality of printhead arrays each performing printing in a predetermined color, the method further including a step of cleaning the plurality of printheads per printhead array depending on a result of inspection made by the image processor.

* * * * *